US009233403B2

(12) United States Patent
Chang

(10) Patent No.: US 9,233,403 B2
(45) Date of Patent: Jan. 12, 2016

(54) NOZZLE OF DUST BLOWER

(71) Applicant: MEI THUNG CO., LTD., Taichung (TW)

(72) Inventor: Sheng-Ming Chang, Taichung (TW)

(73) Assignee: Mei Thung Co., Ltd., Taichung (TW)

( * ) Notice: Subject to any disclaimer, the term of this patent is extended or adjusted under 35 U.S.C. 154(b) by 432 days.

(21) Appl. No.: 13/891,353

(22) Filed: May 10, 2013

(65) Prior Publication Data

US 2014/0331447 A1 Nov. 13, 2014

(51) Int. Cl.

| | |
|---|---|
| ***A47L 9/08*** | (2006.01) |
| ***B08B 5/02*** | (2006.01) |
| ***B05B 1/20*** | (2006.01) |
| ***B05B 1/00*** | (2006.01) |

(52) U.S. Cl.
CPC . *B08B 5/02* (2013.01); *B05B 1/005* (2013.01); *B05B 1/20* (2013.01); *A47L 9/08* (2013.01)

(58) Field of Classification Search
CPC ..... A47L 9/08; B08B 5/02; B05B 1/005; B05B 1/20
USPC ..... 15/421, 405, 408
IPC ..... A47L 9/08
See application file for complete search history.

(56) References Cited

U.S. PATENT DOCUMENTS

| | | | | |
|---|---|---|---|---|
| 6,051,055 A * | 4/2000 | Ukawa | B01D 53/18 261/115 |
| 2012/0216369 A1* | 8/2012 | Vinci | B08B 5/02 15/405 |

* cited by examiner

*Primary Examiner* — David Redding
(74) *Attorney, Agent, or Firm* — Rosenberg, Klein & Lee

(57) ABSTRACT

A nozzle of dust blower is mainly a hollow tube with one open end connected to the dust blower and the other end a closed end. The wall near the closed end has several outlets on the same side toward a radial direction of the tube, so that the high-pressure air blown by the dust blower into the tube blows out of the outlets in the radial direction. Corresponding to each of the outlets, the tube has an auxiliary nozzle base. Each nozzle base has a passage connected to the corresponding outlet. The passage of each of the nozzle bases extends along the radial direction of the tube. The end of each of the nozzle bases near the tube has at least one inlet, so as to suck more air into the nozzle base as the air is blown out.

3 Claims, 5 Drawing Sheets

NOZZLE OF DUST BLOWER

BACKGROUND OF THE INVENTION

1. Field of Invention

The invention relates to a nozzle of dust blower and, in particular, to a nozzle whose outlets are on a single side.

2. Related Art

A conventional dust blower nozzle is shown in FIG. 5. It is a hollow tube 7 with a line of outlets 71 opened on one side of the tube 7. The high-pressure air connected to the dust blower 72 therefore blows out of the outlets 71 in a radial direction of the tube 7.

However, due to the structure of the nozzle, the airflow right outside the outlets 71 immediately diffuses instead of forming a concentrated flow. On the other hand, the airflow out of such a nozzle structure depends on the high-pressure air source connected to the dust blower 72. To obtain a larger airflow, one has to increase the power of the high-pressure air source at a higher cost.

It is thus an objective of the invention to provide a better solution.

SUMMARY OF THE INVENTION

An objective of the invention is to provide a nozzle of dust blower whose outlets are formed in a line on a same side of the tube in a radial direction. Corresponding to each of the outlets, the tube has an auxiliary nozzle base to assist the air blown out of the corresponding outlet. They have the effect of increasing the airflow.

To achieve the above-mentioned objective, the disclosed nozzle of dust blower is a hollow tube with one open end connected to the dust blower and the other end a closed end. A wall near the closed end has several outlets on the same side toward a radial direction of the tube, so that the high-pressure air blown by the dust blower into the tube blows out of the outlets in the radial direction. Corresponding to each of the outlets, the tube has an auxiliary nozzle base. Each nozzle base has a passage connected to the corresponding outlet. The passage of each of the nozzle bases extends along the radial direction of the tube. The end of each of the nozzle bases near the tube has at least one inlet.

Moreover, the outlets are formed at equal distance on the wall of the tube along the axial direction thereof.

Besides, each nozzle base has an inlet on two opposite sides of the end near the tube.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

The present invention will be apparent from the following detailed description, which proceeds with reference to the accompanying drawings, wherein the same references relate to the same elements.

Figure 1:
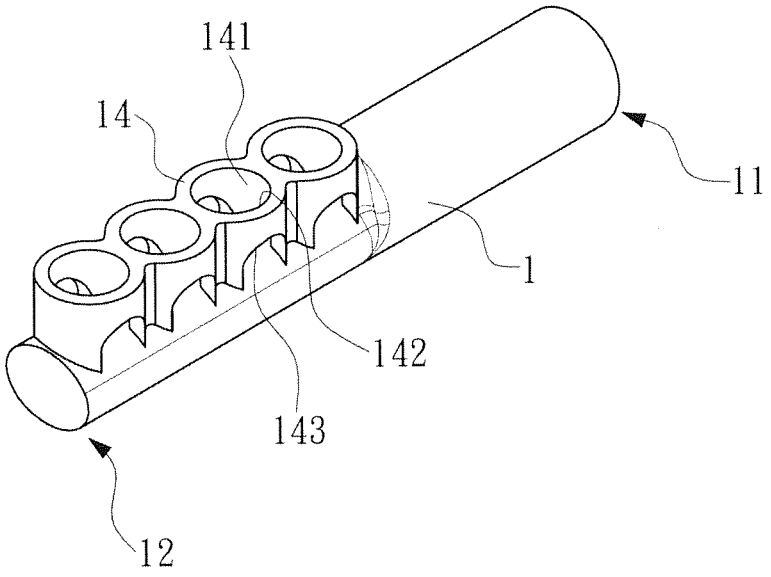
FIG. 1 is a three-dimensional view of the invention.
Figure 2:
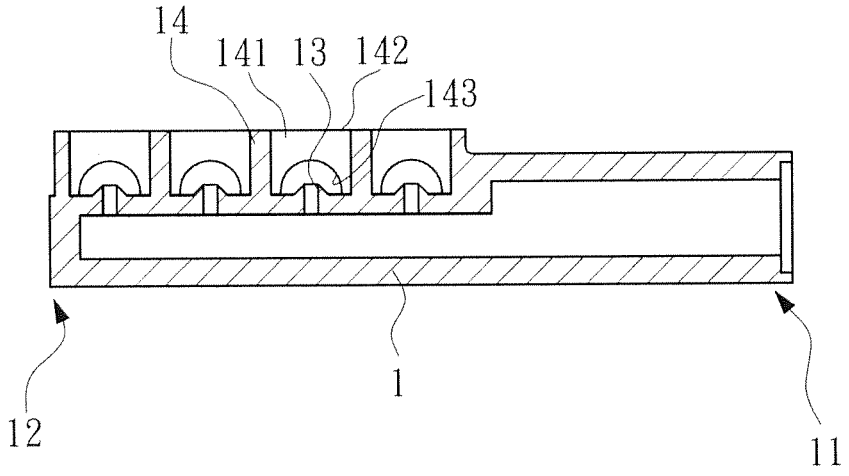
FIG. 2 is a cross-sectional view of the invention.
Figure 3:
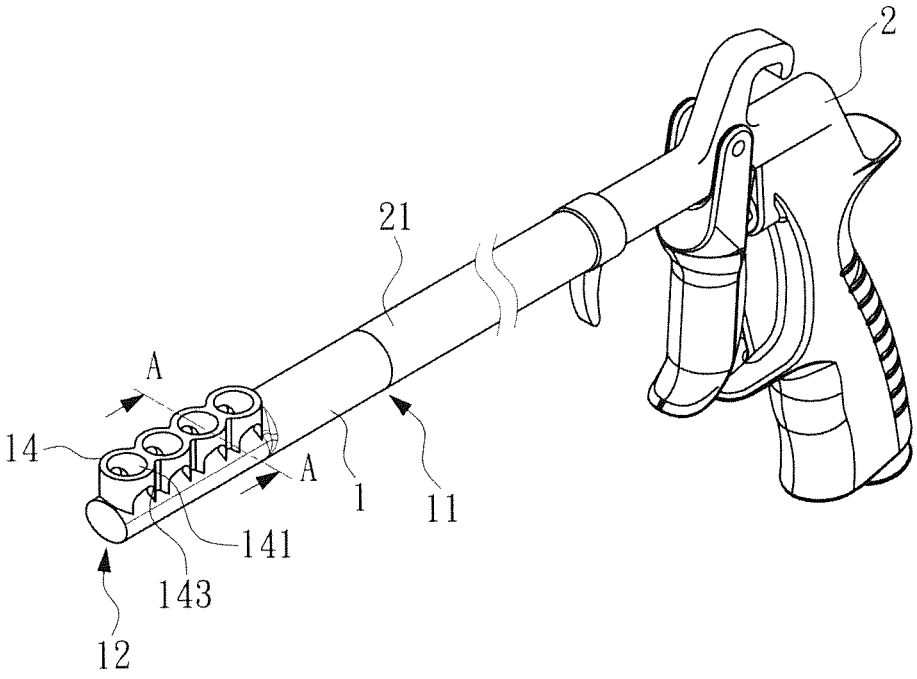
FIG. 3 is a three-dimensional view of the invention installed on a dust blower.

Please refer to FIGS. 1 and 2 for the disclosed nozzle of dust blower. It is mainly a hollow tube 1. Along the axial direction of the tube 1, one end is an open end 11 for the connection of a dust blower (not shown). As shown in FIG. 3, the open end 11 of the tube 1 can first connect to an extension tube 21 and then to the dust blower 2, thereby extending the length of the invention. The other end of the tube 1 is a closed end 12. On the wall near the closed end 12, there are several through outlets 13 on the tube 1 in the radial direction. When the dust blower sends high-pressure air from a high-pressure air source into the tube 1, the air is blown out in the radial direction via the outlets 13.

In this embodiment, the outlets 13 are formed on the same side of the wall of the tube 1 in the axial direction. The outlets 13 are formed at equal distance. Corresponding to each of the outlets 13, the tube 1 is provided with an auxiliary nozzle base 14 for assisting the air blown out of the outlets 13 to form a jet. Each of the nozzle bases 14 has a cylindrical structure, with a passage 141 formed therein. Each of the nozzle bases 14 uses the passage 141 thereof to connect to the corresponding outlet 13. Each of the passages 141 extends in the axial direction of the tube 1. At the end of each of the passages 141 is formed with a nozzle 142. Besides, each of the nozzle bases 14 has a connecting end connecting to the tube, and each connecting end is formed with at least one inlet 143. In this embodiment, two opposite sides of the connecting end of each of the nozzle bases 14 near the tube 1 are formed with one inlet 143, respectively.

With the above-mentioned nozzle structure, one feature of the invention is the cylindrical structure of the nozzle base 14. It focuses the air out of each of the outlet 13 and then ejects it out of the nozzle 142 of the nozzle base 14. The cylindrical airflow thus formed is ejected in the radial direction of the tube 1, enhancing the air blowing power of the dust blower.

Figure 4:
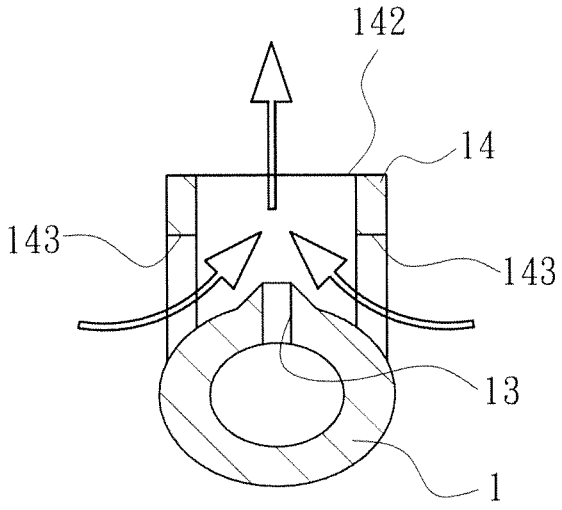
FIG. 4 is a cross-sectional view of FIG. 3 along the A-A line.
Figure 5:
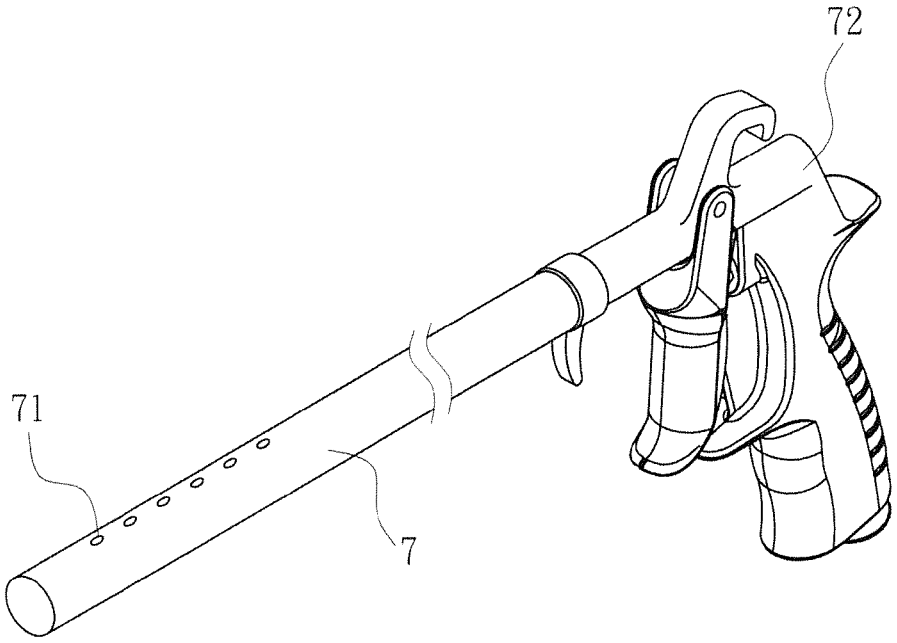
FIG. 5 PRIOR ART
FIG. 5 is a three-dimensional view of a conventional dust blower nozzle.

Moreover, as shown in FIG. 4, the dust blower ejects air via the outlets 13 and the air passes through the nozzle bases 14 to form cylindrical airflows. Due to the Bernoulli principle, the pressure in the passage 141 of each of the nozzle bases 14 is smaller than the ambient space. Therefore, the air outside the nozzle base 14 is sucked in and merges with the cylindrical airflow into one. More explicitly, the air outside the nozzle base 14 is driven by the pressure difference to enter the passage 141 via the inlet 143 of the nozzle base 14 and merge with the cylindrical airflow inside the passage 141, thereby increasing the ejected airflow. In other words, for the airflow ejected by the dust blower to reach a specific value, one only needs a lower driving force using the invention. Therefore, the cost is also lower.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. A nozzle of dust blower comprising a hollow tube with one end being an open end for the connection of a dust blower and the other end being a closed end, a plurality of through outlets being formed near the closed end on the tube in a radial direction of the tube for high-pressure air sent into the tube by the dust blower to flow out; wherein each of the outlets has an auxiliary nozzle base with a passage extending in the radial direction of the tube and each passage connects to the corresponding outlet, each nozzle base has a connecting end connecting to the tube, and each connecting end is formed with at least one inlet.

2. The nozzle of dust blower of claim 1, wherein the outlets are formed at equal distance in the axial direction of the tube.

3. The nozzle of dust blower of claim 1, wherein two opposite sides on the connecting end of each of the nozzle bases have respectively an inlet.

* * * * *